United States Patent [19]

Lanzillotta et al.

[11] Patent Number: 4,759,684

[45] Date of Patent: Jul. 26, 1988

[54] WHEELCHAIR LIFT

[76] Inventors: Amerigo Lanzillotta, 446 Kitty La.; Ronald J. Kruse, 577 Chapelacres Ct.; Aloysius E. Rolfes, 644 Conina Dr., all of Cincinnati, Ohio 45238

[21] Appl. No.: 3,757

[22] Filed: Jan. 16, 1987

[51] Int. Cl.[4] ..... A47C 31/00

[52] U.S. Cl. ..... 414/678; 187/8.41; 187/8.77; 254/3 C; 414/590; 414/921

[58] Field of Search ..... 414/590, 678, 921; 187/8.41, 8.61, 8.65, 8.77; 403/84, 92, 96, 105, 113; 108/6, 8

[56] References Cited

U.S. PATENT DOCUMENTS

| | | | |
|---|---|---|---|
| 1,884,192 | 10/1932 | Perry | 187/8.41 |
| 1,898,666 | 2/1933 | Isaacson | 108/6 |
| 2,147,030 | 2/1939 | Haskin | 187/8.41 |
| 2,621,689 | 12/1952 | Fordon | 403/92 X |
| 3,013,634 | 12/1961 | Sallier | 187/8.41 |
| 3,476,404 | 11/1969 | Rachman | 414/640 X |
| 3,888,463 | 6/1975 | O'Brien et al. | 414/921 X |
| 4,592,695 | 6/1986 | McConnell | 414/678 |

*Primary Examiner*—Leslie J. Paperner

*Attorney, Agent, or Firm*—Brady, O'Boyle & Gates

[57] ABSTRACT

A wheelchair lift which permits the wheelchair to be lifted to an appropriate height by means of a vertically adjustable pedestal including telescoping circular cylinders. The pedestal also includes a generally circular base of a predetermined height for housing the lifting cylinders, a typical example being a hydraulic unit for lifting a barber chair. The lift comprises a pair of elongated generally parallel upwardly facing channel members disposed on either side of the pedestal base for receiving and supporting the wheels of a wheelchair which has been rolled into position thereon. The parallel channels are connected to the uppermost lifting cylinder by means of a downwardly facing channel member which includes a top portion secured to the lift cylinder and two side arm portions extend outwardly and downwardly over the base where they are attached to the parallel channel members intermediate their length. A flat plate extends between the two parallel channel members at the front part thereof for providing not only structural support, but also an entry ramp for the wheelchair.

17 Claims, 3 Drawing Sheets

WHEELCHAIR LIFT

BACKGROUND OF THE INVENTION

1. Field of the Invention

This invention relates generally to elevating structures for wheelchairs and more particularly to a wheelchair lift which permits a person in a wheelchair to be treated, for example, by a dentist, physician or a barber.

2. Description of the Prior Art

Devices for hoisting or lifting a wheelchair are generally known. The following U.S. Patents comprise typical examples of such apparatus: U.S. Pat. No. 2,849,0511- G. W. Streeter, III, Aug. 26, 1958; U.S. Pat. No. 3,516,559- E. G. Walter, June 23, 1970; U.S. Pat. No. 3,985,389- R. B. Bonfield, Oct. 12, 1976; U.S. Pat. No. 4,127,200- E. T. Mann, Nov. 28, 1978; U.S. Pat. No. 4,399,570- G. B. Tracy, Aug. 23, 1983; and U.S. Pat. No. 4,576,539- H. R. Williams, Mar. 18, 1986.

The Williams and Walter patents disclose elevating structures for wheelchairs which are to be loaded onto a vehicle. the Streeter and Bonfield patents disclose means incorporated in the wheelchair itself for elevating it to some desired height. The Mann and Tracy patents disclose still other concepts for hoisting or lifting a wheelchair.

A hydraulic lift which includes an H-frame for lifting an automobile or the like is furthermore disclosed in U.S. Pat. No. 3,061,044, A. Shotmeyer.

While the above noted prior art presumably operates as intended, they are limited in their application and are not suited for the purpose intended by the subject invention.

It is an object of the present invention, therefore, to provide an improvement in apparatus for lifting or elevating a wheelchair.

It is another object of the invention to provide an improvement in apparatus for lifting a wheelchair wherein a person in a wheelchair can ride up on the device and be elevated to any desired height.

And it is yet a further object of the invention to provide a simple yet rugged device which permits a person in a wheelchair to be treated or operated on in an elevated position without leaving the wheelchair.

SUMMARY OF THE INVENTION

The foregoing and other objects are achieved by a wheelchair lift attached or otherwise secured to a vertically adjustable pedestal assembly such as an electric or hydraulic base unit which includes a plurality of telescoping circular cylinders which project upwardly when actuated. The lift comprises a downwardly facing channel member of predetermined width and length which folds down over the pedestal assembly where it is attached to a pair of elongated generally parallel wheelchair support members in the form of upwardly facing channel members which extend out beyond the pedestal assembly so that a person in a wheelchair can ride up on the support members and be elevated to any desired height through activation of the circular cylinders in the base unit. Additionally, there is included a generally flat plate which extends across the front part of the structure between the two parallel channel members for providing not only structural support, but also acts as an entry ramp and support for the wheels, such as the front wheels, of the wheelchair. The downwardly facing connecting channel which comprises a transverse member additionally includes a pair of elongated slots near the lower end thereof where it connects to the parallel wheelchair support channels for permitting unobstructed passage of the lower portion of the wheelchair onto the support members.

BRIEF DESCRIPTION OF THE DRAWING

While the present invention is defined in the claims annexed to and forming a part of the specification, a better understanding can be had by reference to the following description taken in conjuction with the accompanying drawings in which:

DESCRIPTION OF THE PREFERRED EMBODIMENT

While the present invention will be shown and described in terms of a wheelchair lift for a barber chair, for example, it should be noted that it is not meant to be limited to such an application because, when desirable, it may also have utility in a dentist or physician's office or other type of facility where it is desired to elevate a person in a wheelchair for purposes of performing some type of service or treatment while still being located in the wheelchair.

Figure 3:
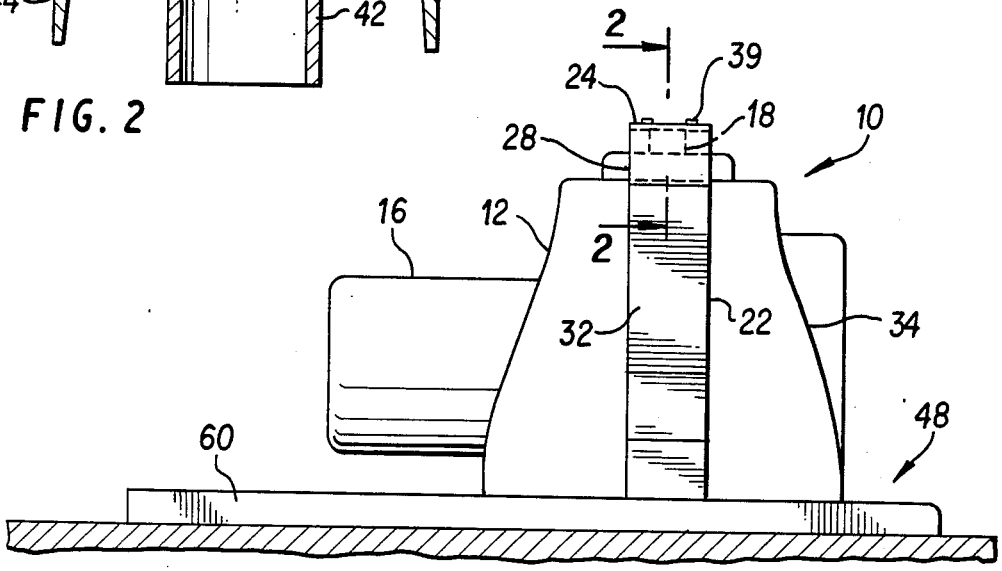
FIG. 3 is a side elevational view of the embodiment shown in FIG. 1.
Figure 4:
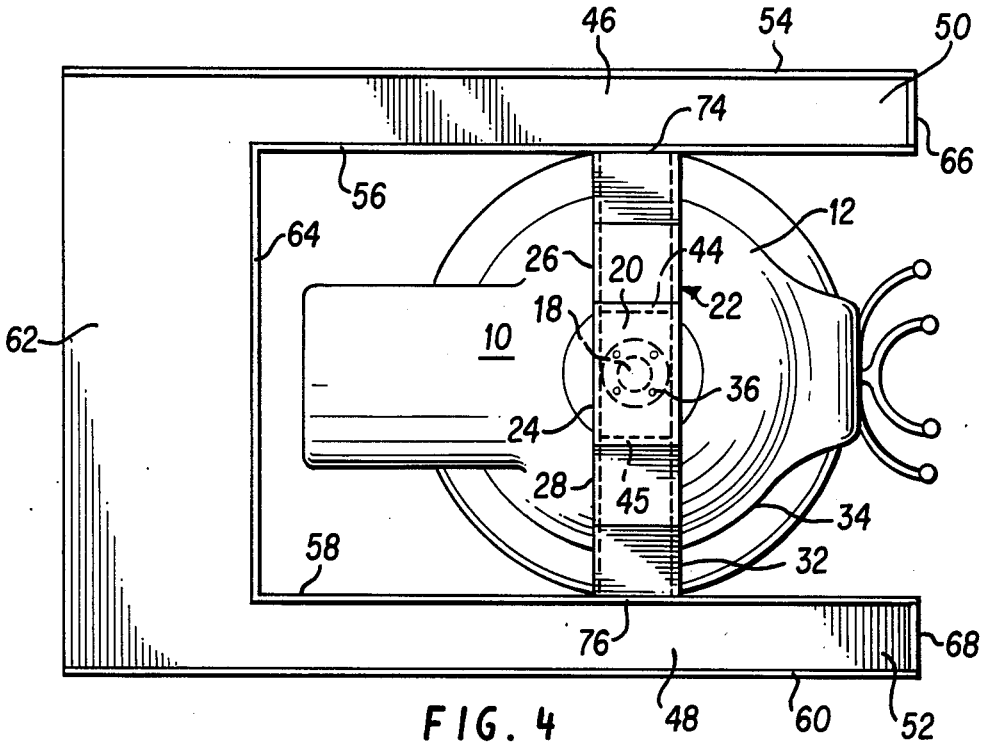
FIG. 4 is a top elevational view of the embodiment shown in FIG. 1.
Figure 5:
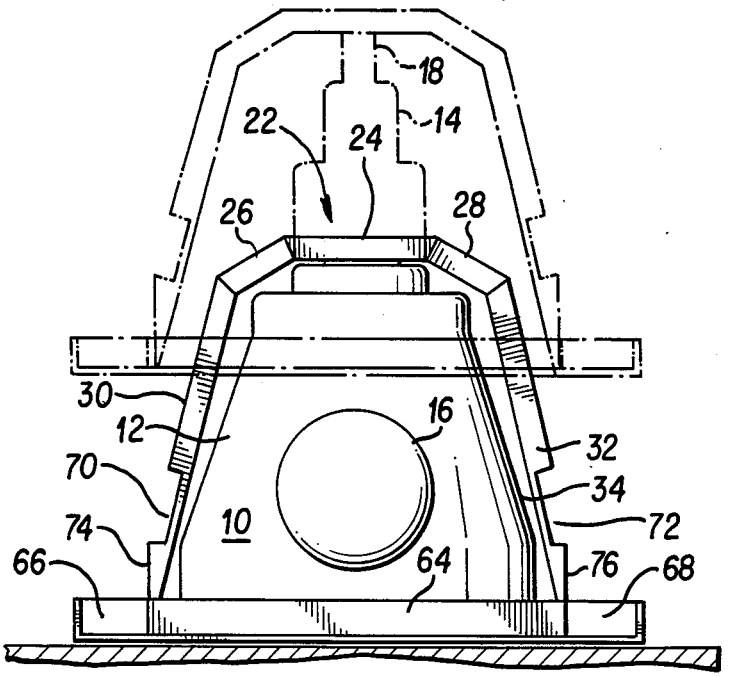
FIG. 5 is a front elevational view of the embodiment shown in FIG. 1.

Referring now to the drawings, reference numeral 10 is intended to designate a vertically adjustable pedestal assembly which may be hydraulically or electrically operated and which includes a base unit 12 of a predetermined height and which is generally circular in configuration and is adapted to house a telescoping circular cylindrical subassembly 14 which when activated, projects upwardly in a generally vertical direction as shown by the phantom lines in FIG. 5. Further as shown in FIGS. 3 and 4, a forwardly projecting housing portion 16 encloses a drive motor, for example, not shown for activating the telescoping cylinders of the assembly 14. Such apparatus is typical of the type of equipment utilized in connection with conventional barber chairs.

Figure 2:
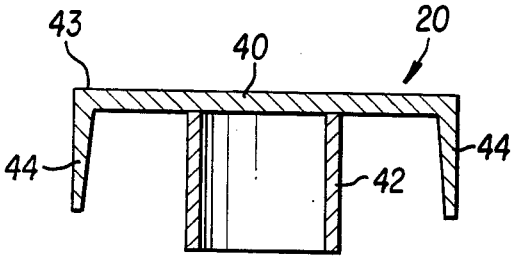
FIG. 2 is a cross sectional view of a coupling element taken along the lines 2—2 of FIG. 3.

The embodiment of the present invention is secured to the uppermost lift cylinder 18 of the base unit 12 by way of a coupling element or cap 20 as shown in FIG. 2. The cap 20 is designed to fit on top of the cylinder 18 and permits the attachment thereto of a transverse downwardly facing channel member 22 having a generally horizontal top portion 24 which is flanked by a pair of slightly descending shoulder portions 26 and 28 (FIG. 5) which respectively join to the pair of outwardly and downwardly extending side arm portions 30 and 32 so as to clear the outer wall surface 34 of the base unit 12. The channel member 22 has a channel member 22 has a constant width as shown in FIG. 3 and the horizontal top portion 24 includes a plurality of bolt holes 36 (FIG. 4) which are aligned with a like plurality of threaded bolt holes for bolts 39 (FIG. 3) formed in the upper portion 40 of the coupling member 20 not shown, which additionally includes a centralized downwardly projecting cylindrical secton 42 which is adapted to fit down into an axial bore or recess, not shown, in the lift cylinder 18. The top surface 43 of the cap 20 is rectangular in configuration so as to fit into the underside of the section 24 of the channel member 22 and terminated in two downwardly projecting end portions 44 and 45 which engage the inside surface of the side members of the channel section 24.

Referring now to FIGS. 4 and 5, a pair of elongated generally parallel wheelchair support members 46 and 48 in the form of two upwardly facing channel members, which are typically 36 inches in length and 3½ inches wide are fastened, bonded or otherwise secured to the lower extremities of the channel arm portions 30 and 32 at approximately one third of the distance, i.e. 12 inches, from the rear end of the channel members 46 and 48 as shown in FIG. 4. The wheelchair support channels 46 and 48 include respective bottom walls 50 and 52 having a width of approximately 3½ inches and generally parallel side walls 54, 56, and 58, 60 having a height of 1 inch or less. The front portion i.e. 9 to 10 inches of the mutually opposing inner side walls 56 and 58 is removed and a generally flat rectangular plate 62 of the same width is located thereat and which extends between the channel members 46 and 48 and being coextensive with the upper surface of the bottom walls 50 and 52 (FIG. 5) to provide not only structural support for the wheel support channels 50 and 52, but also to act as an entry ramp and wheel support for a wheelchair when rolled onto the channel members 50 and 52. Additionally, a generally vertical backplate member 64 is bonded to the rear edge of the plate 62 and is designed to have a height substantially equal to the height of the adjoining side walls 56 and 58. Also, a pair of relatively short back plates 66 and 68, having a height substantially equal to the height of the side walls 54, 56, and 58–60, is secured to the rear end of the wheel support channels 50 and 52 to provide a wheel stop.

Figure 1:
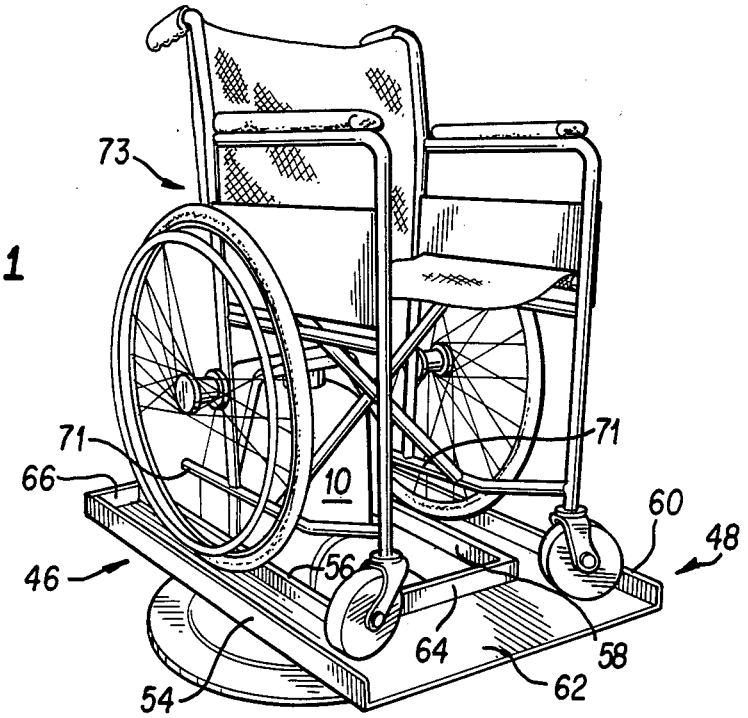
FIG. 1 is a perspective veiw of the preferred embodiment of the subject invention.

In order to accommodate a conventional wheelchair and permit the unobstructed passage of the wheelchair onto the parallel support channels 46 and 48, the lower extremities of the two depending support channel portions 30 and 32 additionally include a respective recess or an elongated slot 70 and 72 which may be either rectangular in configuration as shown in FIG. 5, or circular, and has for their purpose providing a clearance space for the passage of the lower front to back struts 71 of a wheelchair 73 as depicted in FIG. 1. Also as shown in FIG. 5, the adjacent lower outer wall surfaces 74 and 76 are configured so that they are generally vertical in order to mate with the inner side walls 56 and 58 so that the bottom walls 50 and 52 as well as the front plate 62 are generally horizontal. Thus the vertical side wall 74 and surfaces 76 do not interfere with the wheels of a wheelchair.

If the pedestal assembly 10 is upright and vertical, then the wheelchair lift assembly as illustrated will also rest substantially flat on the floor in the rest position; however, when desirable, the two parallel wheel support members 46 and 58 can be designed to provide a slight back to front tilt. Although not shown, wheels or casters could be secured to the pedestal housing 12 when desired for moving the entire assembly easily from one place to another as needed.

Figure 6:
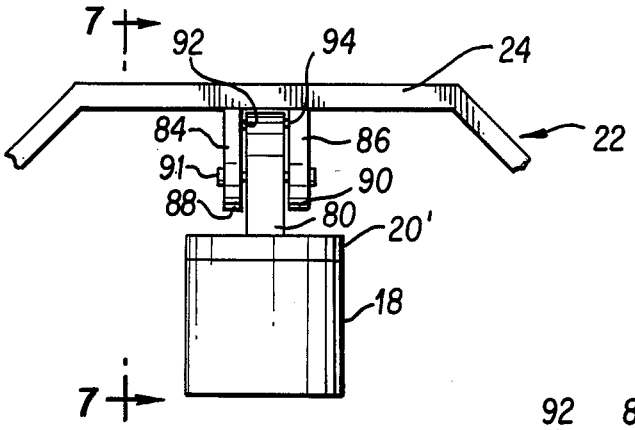
FIG. 6 is a partial front elevational view of a modification of the coupling element shown in FIG. 2 so as to include a tilting mechanism.
Figure 7:
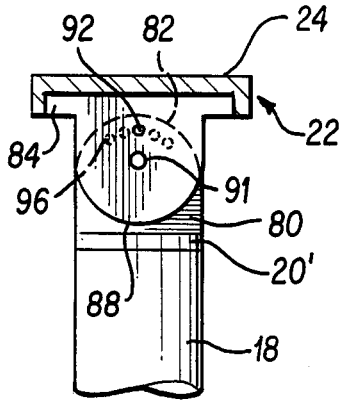
FIG. 7 is a partial cut-away view of the structure shown in FIG. 6 taken along the lines 7—7 thereof.
Figure 8:
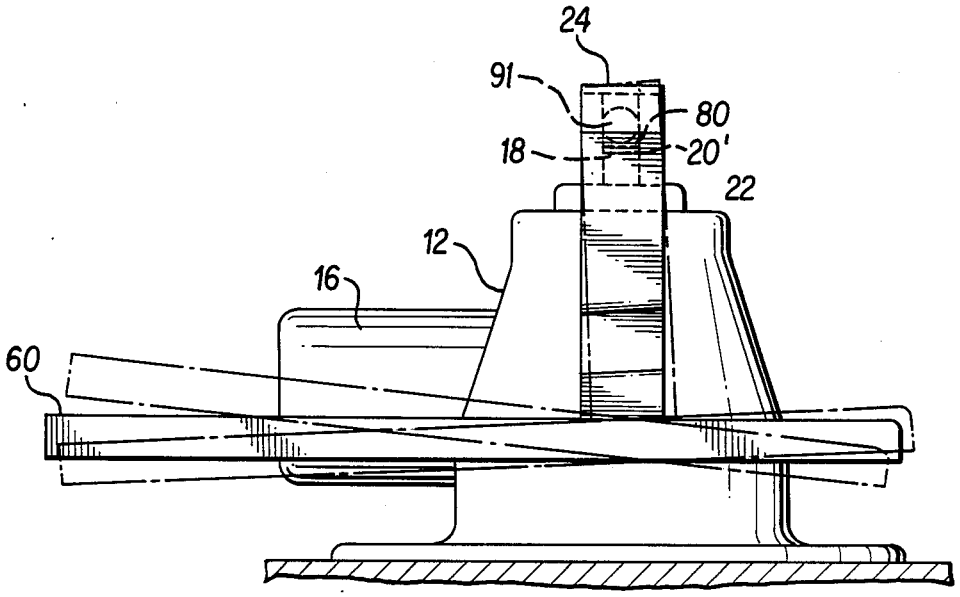
FIG. 8 is a fragmentary view of FIG. 7 and being further illustrative of the tilting mechanism.

A modification of the connection of the transverse channel 22 to the vertically adjustable pedestal assembly 10 includes a pivot with a ball type detent mechanism on the upper part of the coupling member which would permit the wheelchair lift to be tilted backwards or even forwards, if need be, as shown in FIGS. 6 through 8.

There a coupling member 20′ fits into the top portion of the upper lift cylinder 18. On the top surface of the coupling member 20′ there is placed an upwardly projecting post 80 having a rounded upper surface 82 as shown in Figure 7. A pair of downwardly projecrting members 84 and 86 having rounded end surfaces 88 and 90 (FIG. 6) are secured to the underside of top portion 24 of the channel member 22 and straddle the post 80. A pivot pin 91 couples the elements 80, 84 and 86 together. A ball type of detent mechanism, including a pir of ball bearings 92 and 94, is formed between the members 80, 84 and 86 by including a plurality of stops 96 consisting of rounded indentations located along a circular race. This permits a number of fixed angular positions of tilt (FIG. 8) to be provided about the pivot 91 by simply moving the lift structure by hand. It should be noted that other types of tilting means can be employed depending on the specific needs of the user.

Thus what has been shown and described is a wheelchair lift which permits a person in a wheelchair to ride up on a pair of generally parallel elongated support members and be elevated to any desired height while being treated by a person positioned alongside.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

We claim:

1. A wheelchair lift secured to a vertically adjustable pedestal assembly, comprising:

a pair of elongated flat and generally parallel wheelchair support members of predetermined width and length disposed on either side of said pedestal assembly for receiving and supporting the wheels of a wheelchair; and a transverse downwardly facing generally concave arcuate channel member secured to the pedestal assembly and having downwardly extending side arm portions connected to the wheelchair support members intermediate their respective extremities, said side arm portions additionally including recess means formed therein for permitting the unobstructed passage of a wheelchair onto said wheelchair support means; and means coupling said transverse channel member to the pedestal assembly.

2. The wheelchair lift as defined by claim 1 wherein said recess means comprises generally horizontal recess means.

3. The wheelchair lift as defined by claim 1 wherein said generally arcuate transverse member includes a generally horizontal top portion secured to said coupling means.

4. The wheelchair lift as defined by claim 1 wherein said arcuate transverse channel member is of predetermined uniform width and length.

5. The wheelchair lift as defined by claim 1 and additionally including a flat transverse member connected to said wheelchair support members in the region of one end thereof for providing an entry ramp.

6. The wheelchair lift as defined by claim 1 wherein said wheelchair support members are comprised of upwardly facing channel members, each including a bottom wall and a pair of mutually parallel side walls, with mutually opposing inner side walls of said wheelchair support members additionally including an open space at the forward end thereof, and a generally flat plate member being joined to and coextensive with said bottom walls at said open space in said side walls which, in addition to providing structural support, acts as an entry ramp for the wheelchair.

7. The wheelchair lift as defined by claim 6 and additionally including a generally vertical back plate member secured to said flat plate member along the rear edge thereof.

8. The wheelchair lift as defined by claim 7 and additionally including a pair of back plates respectively connected across the side walls of said channel members at the rear end thereof for providing a travel stop of the wheels of said wheelchair.

9. The wheelchair lift as defined by claim 1 wherein said recess is formed a predetermined height above said wheelchair support members for permitting the passage of the lower portion of a wheelchair onto said support member.

10. The wheelchair lift as defined by claim 9 wherein said wheelchair support members are comprised of a pair of upwardly facing channel members.

11. The wheelchair lift as defined by claim 10 and wherein said upwardly facing channel members comprising said wheelchair support members include a bottom wall and a pair of mutually parallel side walls, with each mutually opposing inner side wall of said channel members additioally including an open space at the forward end thereof and generally flat plate member which is joined to and coextensive with said bottom walls at said open space in the side walls which, in addition to providing structural support, act as an entry ramp for the wheelchair.

12. The wheelchair lift as defined by claim 1 wherein said pedestal assembly includes lift means located within a vertically oriented base of a predetermined height, said coupling means being located on said lift means for lifting said wheelchair to a desired height, and wherein said base comprises a generally circular base and wherein said lift means includes a telescoping cylindrical subassembly including a plurality of cylinders powered by means for selectively raising a wheelchair on said lift to a desired height and wherein said coupling means is located on the uppermost cylinder.

13. The wheelchair lift as defined by claim 12 wherein said coupling means comprises a member which fits over the top portion of said uppermost cylinder and includes a substantially flat top portion which engages and supports said transverse downwardly facing channel member.

14. The wheelchair lift as defined by claim 1 and additionally including means for selectively varying the tilt of said wheelchair support members about a longitudinal axis parallel to their length dimension.

15. The wheelchair lift as defined by claim 14 wherein said means for varying the tilt of said support are located in said coupling means.

16. The wheelchair lift as defined by claim 15 wherein said tilt varying means comprises a detent mechanism including a plurality of stops.

17. The wheelchair lift as defined by claim 16 wherein said detent mechanism includes an upwardly pointing post member having a pair of flat opposing side walls, a downwardly pointing bifurcated member straddling said post member and said side walls thereof, a pivot member joining the post member and said bifurcated members, said stops further comprising a race between said side walls and said bifurcated members and at least one ball detent located in said race.

* * * * *